US010850185B2

(12) United States Patent
Fechser

(10) Patent No.: US 10,850,185 B2
(45) Date of Patent: Dec. 1, 2020

(54) WORD-FORMING AND WORD-GUESSING GAME

(71) Applicant: Ted J. Fechser, Las Vegas, NV (US)

(72) Inventor: Ted J. Fechser, Las Vegas, NV (US)

(73) Assignee: Ted J. Fechser, Las Vegas, NV (US)

( * ) Notice: Subject to any disclaimer, the term of this patent is extended or adjusted under 35 U.S.C. 154(b) by 0 days.

(21) Appl. No.: 16/250,339

(22) Filed: Jan. 17, 2019

(65) Prior Publication Data

US 2019/0143196 A1 May 16, 2019

Related U.S. Application Data

(63) Continuation of application No. 15/274,084, filed on Sep. 23, 2016, now Pat. No. 10,195,517.

(Continued)

(51) Int. Cl.

*A63F 3/04* (2006.01)
*A63F 3/00* (2006.01)

(Continued)

(52) U.S. Cl.

CPC ..... *A63F 3/0423* (2013.01); *A63F 3/0421* (2013.01); *A63F 5/046* (2013.01);

(Continued)

(58) Field of Classification Search

CPC ..... A63F 3/0423; A63F 2003/00605; A63F 3/0421; A63F 2001/0416; A63F 2001/0466; A63F 5/046; A63F 2009/0479; A63F 2009/186; A63F 2003/0426; A63F 2011/0016

(Continued)

(56) References Cited

U.S. PATENT DOCUMENTS 2,476,194 A * 7/1949 Hollowell ..... A63F 9/0811 273/155
3,302,311 A * 2/1967 Israel ..... A63F 9/12 273/155

(Continued)

FOREIGN PATENT DOCUMENTS

FR 2774306 A1 8/1999
GB 552508 A 4/1943

OTHER PUBLICATIONS

Extended European Search Report, dated Jul. 17, 2017, for EPO Application No. 17158278.6 (related to parent application of this instant application).

(Continued)

*Primary Examiner* — Vishu K Mendiratta
(74) *Attorney, Agent, or Firm* — Roeder & Broder LLP; Steven G. Roeder

(57) ABSTRACT

A method for playing a word-forming and word-guessing board game (10) between at least a first player and a second player includes (i) each of the players selecting a letter tile set (20), a card deck (22) and a dice set (26); (ii) each of the players utilizing a predetermined number of letter tiles (20) from their letter tile set (20) to form a word that is hidden from each of the other players; (iii) the first player utilizing their card deck (22) and their dice set (26) to win an opportunity to guess the word of any of the other players; and (iv) the first player making a guess of the word of any of the other players.

5 Claims, 10 Drawing Sheets

Related U.S. Application Data

(60) Provisional application No. 62/303,840, filed on Mar. 4, 2016.

(51) Int. Cl.

| | |
|---|---|
| *A63F 1/04* | (2006.01) |
| *A63F 5/04* | (2006.01) |
| *A63F 9/04* | (2006.01) |
| *A63F 9/18* | (2006.01) |
| *A63F 11/00* | (2006.01) |

(52) U.S. Cl.
CPC ..... *A63F 2001/0416* (2013.01); *A63F 2001/0466* (2013.01); *A63F 2003/00605* (2013.01); *A63F 2003/0426* (2013.01); *A63F 2009/0479* (2013.01); *A63F 2009/186* (2013.01); *A63F 2011/0016* (2013.01)

(58) Field of Classification Search
USPC ..... 273/272, 299
See application file for complete search history.

(56) References Cited

U.S. PATENT DOCUMENTS

| | | | | |
|---|---|---|---|---|
| 3,427,028 | A * | 2/1969 | Abrahamsen | A63F 3/0423 273/272 |
| 3,565,439 | A | 2/1971 | Krouse et al. | |
| 4,084,816 | A | 4/1978 | Shafer | |
| 4,165,077 | A * | 8/1979 | Falcione | A63F 9/0098 273/239 |
| 4,236,719 | A * | 12/1980 | Kerr | A63F 9/0098 273/265 |
| 4,410,182 | A * | 10/1983 | Francis | A63F 3/0415 273/268 |
| 4,682,777 | A | 7/1987 | Wood | |
| 4,934,711 | A * | 6/1990 | Runstein | A63F 3/0423 273/272 |
| 5,139,271 | A | 8/1992 | Bez | |
| 6,422,562 | B1 | 7/2002 | Daniel | |
| 6,612,766 | B2 * | 9/2003 | Collins | B43K 7/005 401/195 |
| 8,496,483 | B1 * | 7/2013 | Walters | G09B 1/14 434/172 |
| 2005/0046111 | A1 | 3/2005 | Orner | |
| 2008/0176193 | A1 * | 7/2008 | Lucy | G09B 19/00 434/129 |
| 2014/0131945 | A1 | 5/2014 | McClung | |

OTHER PUBLICATIONS

Response to Extended European Search Report (dated Jul. 17, 2017) filed Mar. 5, 2018, for EPO Application No. 17158278.6 (related to parent application of this instant application).

* cited by examiner

WORD-FORMING AND WORD-GUESSING GAME

RELATED APPLICATION

This Application is a continuation application of U.S. patent application Ser. No. 15/274,084 filed on Sep. 23, 2016 and entitled "Word-Forming And Word-Guessing Game." U.S. patent application Ser. No. 15/274,084 is related to and claims priority on U.S. Provisional Patent Application Ser. No. 62/303,840 filed on Mar. 4, 2016, entitled "WORD-FORMING AND WORD-GUESSING GAME". As far as is permitted, the contents of U.S. patent application Ser. No. 15/274,084 and U.S. Provisional Patent Application Ser. No. 62/303,840 are incorporated herein by reference.

FIELD OF THE INVENTION

The present invention relates to the field of card, dice and/or letter tile-based word-forming and/or word-guessing games, including without limitation, organized, instruction-based games or board games.

BACKGROUND

It is a popular activity for individuals to entertain themselves with other individuals by playing organized instruction-based games, particularly games involving strategy, intellect, opposition, and the like. There are, therefore, a wide variety of games employing various modes of play and requiring varying degrees of strategy and intellect. In different embodiments, such games can include multi-player games, single-player games, and games played on and/or against a computer. Additionally, such instruction-based game sets are readily available ranging from games with a simple mode of play or singular game element such as letter tiles, to complex modes of play and layered, multiple game elements such as letter tiles and dice, for example. Many of these games are turn-based and involve multiple players.

Certain of these types of games involve word-forming and word-guessing parameters, including but not limited to word-forming through the use of letter tiles. A well-known and popular turn-based board game involving word-forming actions via the use of letter tiles is Scrabble®.

As provided herein, the word-forming and word-guessing game of the present invention provides a unique and highly entertaining option for fulfilling an individual's desire to employ strategy, intellect, and opposition in executing a complex mode of play with layered, multiple game elements such as sets of card decks, sets of dice, and sets of letter tiles.

SUMMARY

The present invention is directed toward a method for playing a multi-player word-forming and word-guessing board game between at least a first player and a second player that is designed to employ strategy, intellect, and opposition in executing a complex mode of play with layered, multiple game components. In various embodiments, the method includes (i) each of the players selecting a letter tile set, a card deck and a dice set; (ii) each of the players utilizing a predetermined number of letter tiles from their letter tile set to form a word that is hidden from each of the other players; (iii) the first player utilizing their card deck and their dice set to win an opportunity to guess the word of any of the other players; and (iv) the first player making a guess of the word of any of the other players.

In some embodiments, the card deck of each of the players includes a card identifier that distinguishes each card deck from each of the other card decks. Somewhat similarly, the dice set of each of the players can include a dice identifier that distinguishes each dice set from each of the other dice sets.

In certain embodiments, each card deck includes a plurality of Dice Cards, a plurality of Dice+Letter Cards, a plurality of Letter Cards, and a plurality of Power Cards. During play of the game, each player chooses one or more cards from their card deck during a Draw Round until they find one of a Dice Card and a Dice+Letter Card. Subsequently, each player utilizes the one of a Dice Card and a Dice+Letter Card found during the Draw Round to determine a number of dice to roll during a Dice Roll Round. Additionally, any of the players can utilize one or more Power Cards to change the number of dice to roll during the Dice Roll Round by one or more of the players.

Further, in some embodiments, the first player is the player with the highest roll during the Dice Roll Round who wins the opportunity to guess the word of any of the other players during a Guess Round. Still further, in such embodiments, the player with the highest roll during the Dice Roll Round is the only player to participate in a Letter Spin Round. The Letter Spin Round determines one or more letters to be revealed from the word formed by each of the players other than the first player. Additionally, the first player can also utilize one or more of the Letter Cards and Dice+Letter Cards from their card deck to determine one or more letters to be revealed from the word formed by each of the players other than the first player.

In certain embodiments, each of the players randomly selects the predetermined number of letter tiles from their letter tile set to be used in forming their word. The word formed by each of the players can include one or more of the predetermined number of letter tiles.

Additionally, the present invention is further directed toward a board game to be played by at least a first player and a second player, the board game including (i) a game board; (ii) a separate letter tile set for each of the players, each player utilizing a predetermined number of letter tiles from their letter tile set to form a word that is hidden from each of the other players; (iii) a separate card deck for each of the players, the card deck of each of the players including a card identifier that distinguishes each card deck from each of the other card decks; and (iv) a separate dice set for each of the players, the dice set of each of the players including a dice identifier that distinguishes each dice set from each of the other dice sets; and wherein the first player utilizes their card deck and their dice set to win an opportunity to guess the word of any of the other players.

Further, the present invention is also directed toward a method for playing a multi-player board game including a plurality of players, the method including (A) each of the players selecting (i) a letter tile set, (ii) a card deck including a plurality of Dice Cards, a plurality of Dice+Letter Cards, a plurality of Letter Cards, and a plurality of Power Cards, each card deck including a card identifier that distinguishes each card deck from each of the other card decks, and (iii) a dice set including a dice identifier that distinguishes each dice set from each of the other dice sets; (B) each of the players randomly selecting a predetermined number of letter tiles from their letter tile set; (C) each of the players utilizing the predetermined number of letter tiles from their letter tile set to form a word that is hidden from each of the other players, the word formed by each of the players including one or more of the predetermined number of letter tiles; (D)

each player choosing one or more cards from their card deck during a Draw Round until they find one of a Dice Card and a Dice+Letter Card, each player utilizing the one of a Dice Card and a Dice+Letter Card found during the Draw Round to determine a number of dice to roll during a Dice Roll Round; (E) each player rolling the number of dice determined during the Draw Round during the Dice Roll Round, the player with the highest roll during the Dice Roll Round being the only player to participate in a Letter Spin Round; (F) the player with the highest roll during the Dice Roll Round spinning a letter wheel during the Letter Spin Round to determine one or more letters to be revealed from the words formed by each of the other players; and (G) the player with the highest roll during the Dice Roll Round winning an opportunity to guess the word of any of the other players during a Guess Round.

It should be appreciated that the Summary of the invention provided herein is not intended to define the claims nor is it intended to limit the scope of the invention in any manner.

Additionally, other features and advantages of the invention will be apparent from the following drawings, detailed description, and the claims appended hereto.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a multi-player, word-forming and word-guessing game that utilizes sets of letter tiles, specially designed card decks and/or dice to control the play of the game. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar nomenclature and/or reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The play-of-game and multiple game elements disclosed herein provide a unique and intellectual means for carrying out a strategic word-forming and word-guessing venture against one or more opponents.

For the purposes of the invention disclosed herein, the terminology "game mechanic" means rules and/or methods dictating interaction amongst the players of a game. Such terminology is interchangeable with the terms "game play" or "play-of-game" or "game" or "game instructions" or "game rules" or "game methods" or a combination of such terms.

Additionally, although the word-forming and word-guessing game as disclosed herein is primarily described in terms of a physically tangible game including physically tangible game pieces and components, it should be appreciated that the game can alternatively formed as an electronic version comprising virtual game pieces and components. Further, it should also be appreciated that in an electronic version of the word-forming and word-guessing, the players in the word-forming and word-guessing can be located remotely from one another and/or the players can be in the same general location.

Figure 1:
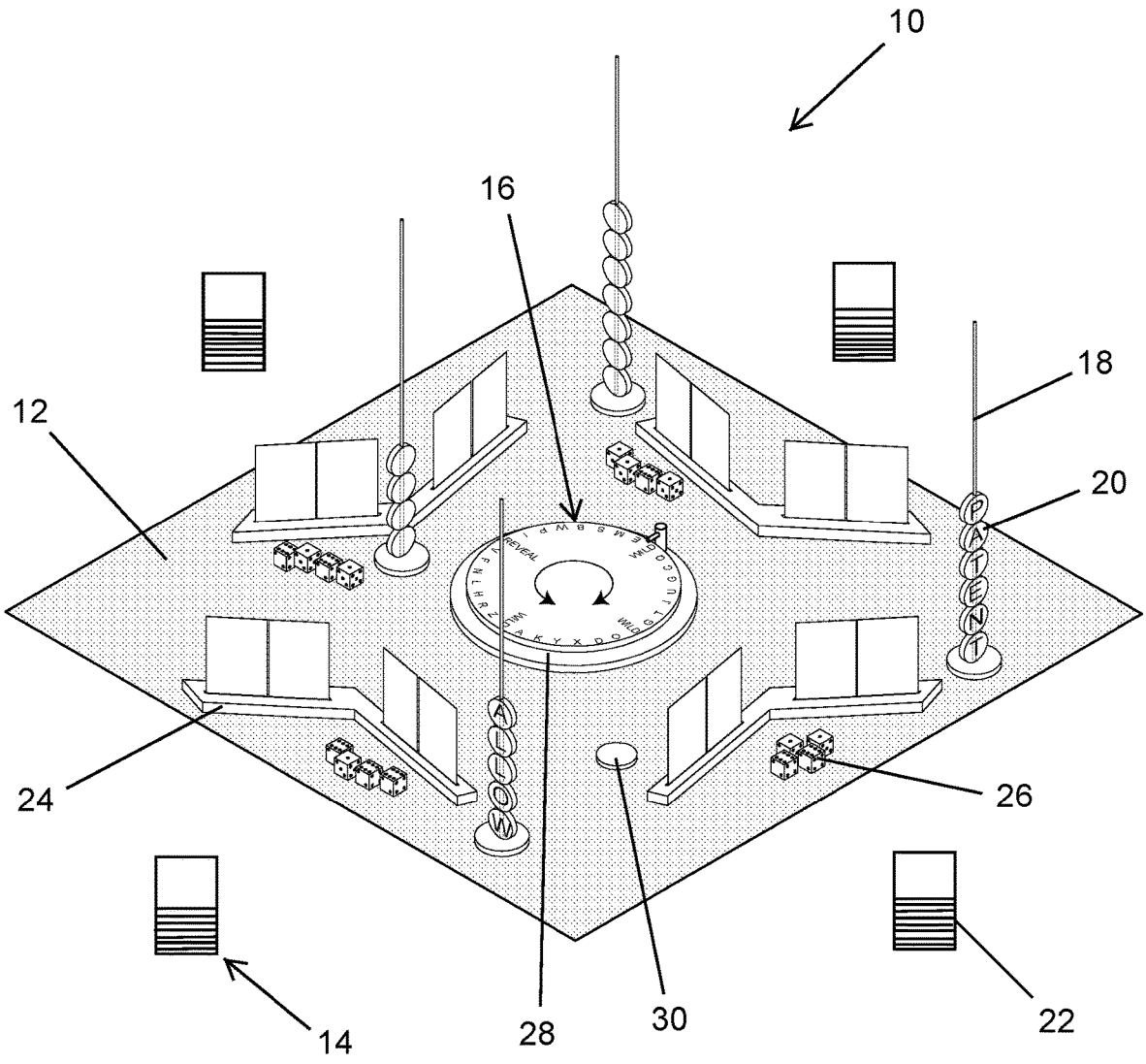
FIG. 1 is a simplified perspective view of an embodiment of a board game having features of the present invention.

FIG. 1 is a simplified perspective view of an embodiment of a word-forming and word-guessing board game 10 (also referred to herein simply as a "board game" or a "game") having features of the present invention. In certain embodiments, the board game 10 of the present invention can be designed to be played by anywhere from two-to-six players. More specifically, FIG. 1 illustrates the board game 10 being set up for play amongst four players. Alternatively, the board game 10 can be played by more than six players or only a single player, e.g., against a computer. In such a single-player game, the computer or other virtual opponent can be considered as another "player". Thus, in such embodiments, the board game 10 can still be considered to be a multi-player board game.

The design of and the various game components included within the board game 10 can be varied. As illustrated in FIG. 1, in certain embodiments, the board game 10 includes a game board 12, a plurality of player-specific components 14, and a plurality of general, game components 16. More particularly, as shown, the player-specific components 14 can include for each player a tile pole 18, a plurality of letter tiles 20 (also sometimes referred to as a "letter tile set"), a plurality of game cards 22 (also sometimes referred to as a "card deck"), a card rack 24, and a dice set 26. Additionally, as shown, the general, game components 16 can include a letter wheel 28 and a game button 30 (also sometimes referred to as a "starter button" or a "control button"). The various player-specific components 14 and general, game components 16 will be described in greater detail herein below with regard to their specific design and function during play of the board game 10.

Alternatively, in different embodiments, the board game 10 can include a greater or lesser number of player-specific components 14 and/or general, game components 16 than those specifically listed and described herein. Still alternatively, the board game 10 can be designed without one or more of the specifically noted player-specific components 14 and/or general, game components 16.

Yet alternatively, in other embodiments, each of the players in the board game 10 can receive and utilize an individual game mat (not shown), e.g., a rolling felt, that can be used in conjunction with or in lieu of the game board 12.

The game 10, the game board 12, and the various game components 14, 16 can be made of materials well-known and readily available to the game and/or board game industry. For example, materials utilized may range from a wide variety of available materials such as, without limitation, plastics, laminates, molded plastics, pasteboard or layered pasteboard, paperboard, cardstock, cover stock board stock, paper substrate, foil board, acrylonitrile-butadien-styrene-copolymer (ABS), phlalate-free polyvinyl chloride (PVC), Sintra® PVC foam board, polyethylene terephthalate glycol-modified (PETG), and/or combinations thereof.

Additionally, for the purposes of the invention disclosed herein, the terminology "corresponds to" means that there is a functional and/or mechanical relationship between objects which correspond to each other. For example, the play-of-game of the board game 10 corresponds to the various game components 14, 16 that can be used during play of the board game 10. In one specific, non-exclusive example, the letter tiles 20 disclosed herein correspond to the tile pole 18 disclosed herein in that each correspond to each other or mechanically interact with each other when the letter tiles 20 are loaded onto the tile pole 18, which is designed in such a manner to accommodate such letter tiles 20.

Figure 2:
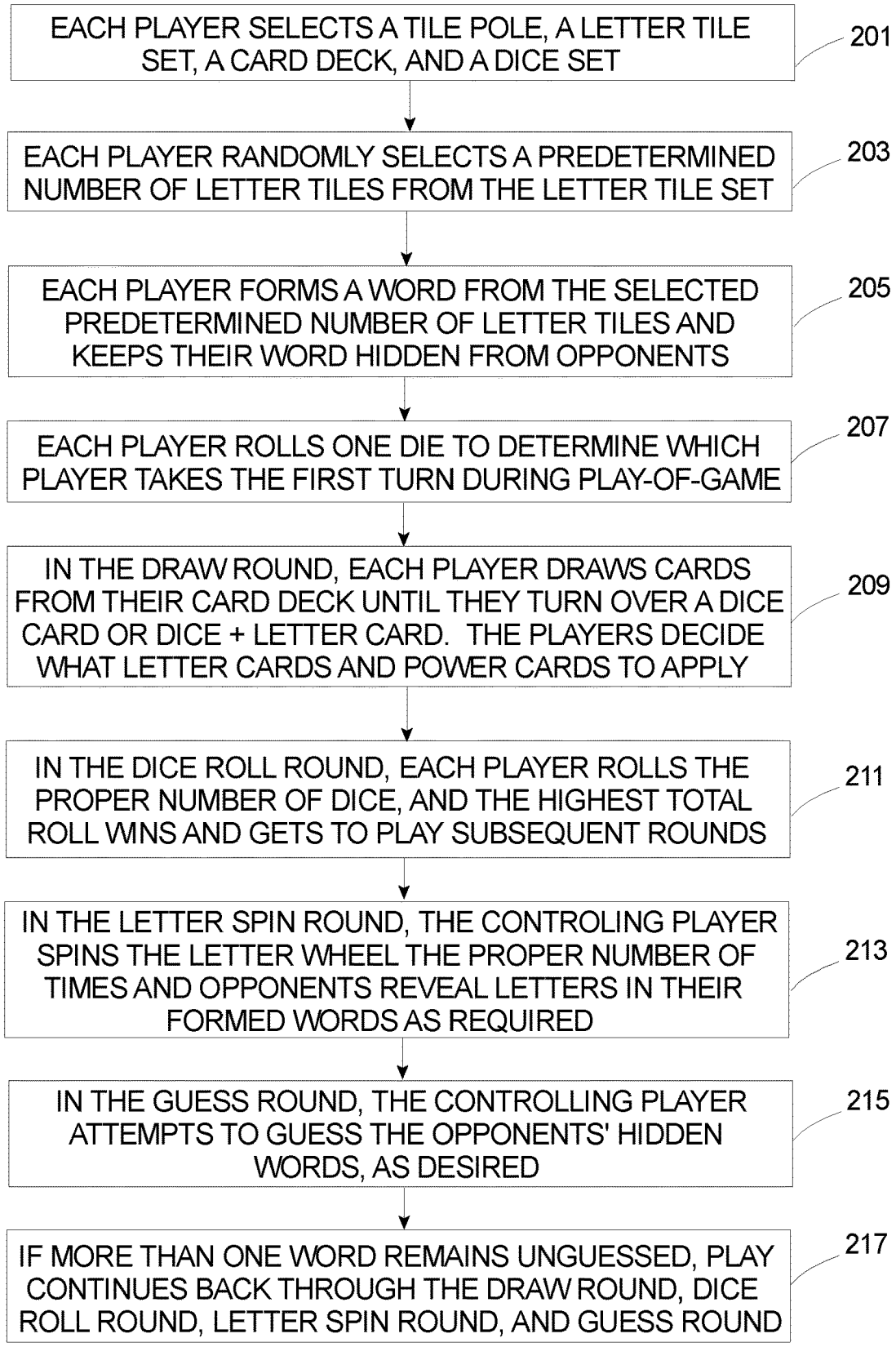
FIG. 2 is a flowchart illustrating an embodiment of a game mechanic utilized in playing the board game illustrated in FIG. 1.

FIG. 2 is a flowchart illustrating an embodiment of a game mechanic, i.e. a set of game rules, utilized in playing the board game 10 illustrated in FIG. 1.

As described in detail herein, game preparation and game play of the word-forming and word-guessing game 10 can include a plurality of steps. It is understood that the various steps described herein can be modified as necessary during the play of the board game 10. Additionally, it should also be appreciated that in certain applications the order of the steps can be modified, certain steps can be omitted, and/or additional steps can be added without limiting the intended scope and breadth of the present invention.

For example, during initial game preparation, in step 201, each player can select a tile pole 18, a plurality of letter tiles 20 (i.e. a letter tile set), a plurality of game cards 22 (i.e. a card deck), and a dice set 26. As discussed in greater detail herein below, in certain embodiments, each of the card decks 22 can include a unique card identifier or card ID (e.g., a color, symbol, shape, design, logo, branding, etc.) that distinguishes one card deck 22 from each of the other card decks 22. Somewhat similarly, in certain embodiments, each dice set 26 can include a unique dice identifier or dice ID (e.g., a color, symbol, shape, design, logo, branding, etc.) that distinguishes one dice set 26 from each of the other dice sets 26.

In step 203, each player randomly, i.e. blindly, chooses a particular predetermined number of letter tiles 20 from their letter tile set 20. The predetermined number of letter tiles 20 that are chosen can be referred to as a "word-forming letter tile set". In some embodiments, such letter tile sets 20 can be housed in a pouch (not shown). The particular predetermined number of letter tiles 20 for play-of-game is typically indicated in the instructions corresponding to the play-of-game for word-guessing and word-forming game elements. In one non-exclusive embodiment, the particular predetermined number of letter tiles 20 for game preparation and play-of-game start is thirteen letter tiles 20 that are chosen from each player's total number of letter tiles 20 (or set of letter tiles 20). Additionally, in certain embodiments, the total number of letter tiles 20 per player within their letter tile set 20 is seventy-five letter tiles 20. In some such embodiments, the letter tile sets 20 per player have the same number of each letter in the alphabet. In one non-exclusive alternative embodiment, the number of the letter tiles 20 of each individual letter in each player's letter tile set 20 is as follows: four letter tiles 20 of each of letters: E, A, R, I, O, and T; three letter tiles 20 of each of letters: N, S, L, C, U, D, P, M, H, G, and B; and two letter tiles 20 of each of letters: F, Y, W, K, V, X, Z, J, and Q.

Additionally, in step 205, each player forms a single word from the particular predetermined number of letter tiles 20, i.e. the word-forming letter set, as selected in step 203, for play-of-game. Each player should keep the formed word hidden from their opponent (or opponents). Not all players will have the same word length every time. It should be appreciated that the strategy (or strategies) utilized by the players in forming the single word can be varied, and can and likely will differ from player to player. Additionally, it should also be appreciated that the various strategies utilized by the players can be developed over time from previous game play. Alternatively, the game 10 can also be played where each player can use their chosen predetermined number of letter tiles 20 to form more than a single word, e.g., a combination of words or a word phrase.

In certain embodiments, the formed word cannot be a proper noun and must be spelled correctly. Additionally, in some embodiments, the formed word must be a word found in a dictionary. For the purposes of the present invention, the usage of dictionaries, apps, and/or the internet to form a word, check the spelling of a word, and/or to help guess a word is not encouraged. However, the usage of a dictionary, app, and/or the internet to check whether the opponent's word formation is a valid word is permitted if the players disagree on whether a particular word is a valid word. It should be understood that play-of-game instructions corresponding to the word-forming and word-guessing game can dictate the rule or rules related to the formed words and such rules may be variable and dependent upon mutual agreement of the players.

Figure 3:
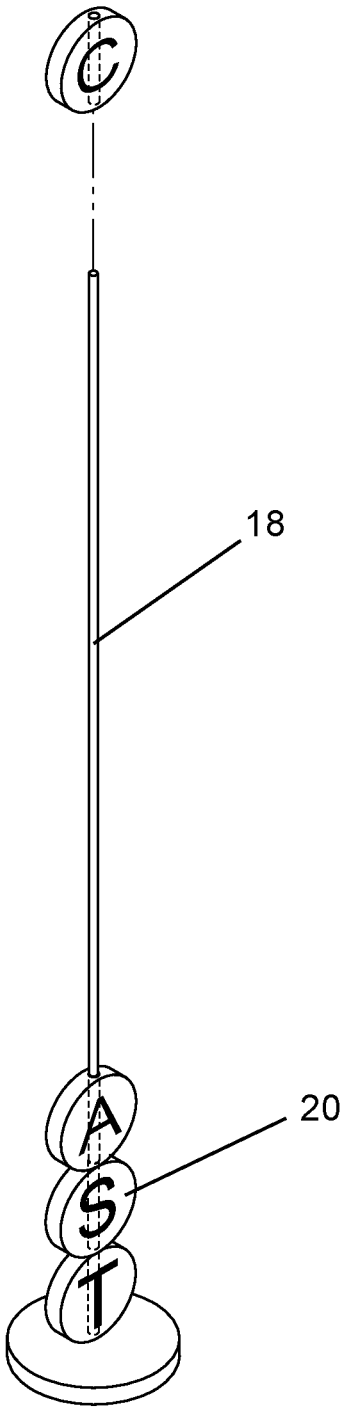
FIG. 3 is a simplified perspective view of an embodiment of a tile pole and a plurality of letter tiles that can be utilized within the board game illustrated in FIG. 1.

FIG. 3 is a simplified perspective view of an embodiment of the tile pole 18 and a plurality of letter tiles 20 that can be utilized within the board game 10 illustrated in FIG. 1. In various embodiments, once the players have decided on their formed word, the players take the letter tiles 20 forming their word and load them onto their tile pole 18 with the last letter of the word stacked first. An exemplary tile pole 18 with loaded letter tiles 20 T S A C, spelling or forming the word CAST when reading the letters from top to bottom is shown in FIG. 3.

Further, in step 207, once a hidden word is formed by each of the players, all the players roll one die each from their dice set 26. The highest roller decides the player who takes the first turn. In one embodiment, the player who takes the first turn also gets the game button 30.

Once the preliminary steps are completed, as described above, game play of the board game 10 begins. As described in detail herein, the word-forming and word-guessing game 10 disclosed herein comprises four rounds: (1) Draw Round, (2) Dice Roll Round, (3) Letter Spin Round (or Letter Die Roll Round if the game 10 includes a Letter Die 1032 (illustrated in FIG. 10) rather than the Letter Wheel 28 (illustrated in FIG. 1)), and (4) Guess Round. As provided herein, play-of-game proceeds through each of the four rounds as many times as necessary until a winner is determined. As utilized herein, each set of four rounds that are played can be referred to as "Set of Rounds".

As noted above, the player who rolled the highest number in step 207 determines which player goes first during regular game play, i.e. during the Draw Round, and that player also receives the game button 30. In some embodiments, the game button 30 passes around to the next player in clockwise fashion after the completion of all four rounds: (1) Draw Round, (2) Dice Roll Round, (3) Letter Spin Round (or Letter Die Roll Round), and (4) Guess Round. After the aforementioned game preparation steps, the word-forming aspect of the game 10 is complete and the word-guessing aspect of the game 10 is ready to begin.

In step 209, each player, in turn, participates in the Draw Round. The Draw Round is a turn-based process for each player that generally proceeds in a clockwise fashion. The Draw Round entails each player selecting one or more cards from his or her card deck 22. In some embodiments, players have the right to cut any and/or all opponents' card decks 22 before the first Draw Round of a game.

Figure 4A:
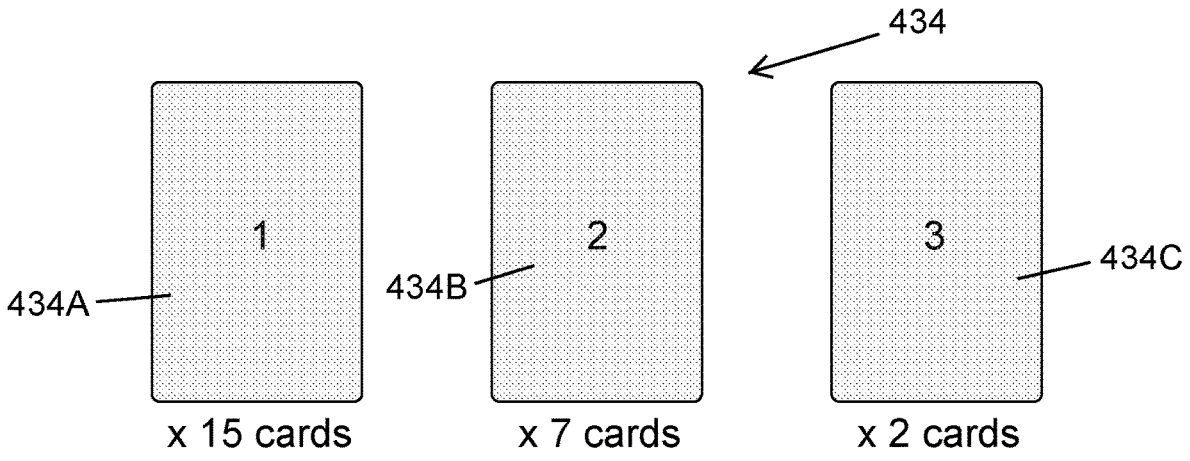
FIG. 4A is a simplified top view illustration of an embodiment of a plurality of Dice Cards that can be utilized by a player within the board game illustrated in FIG. 1.
Figure 4B:
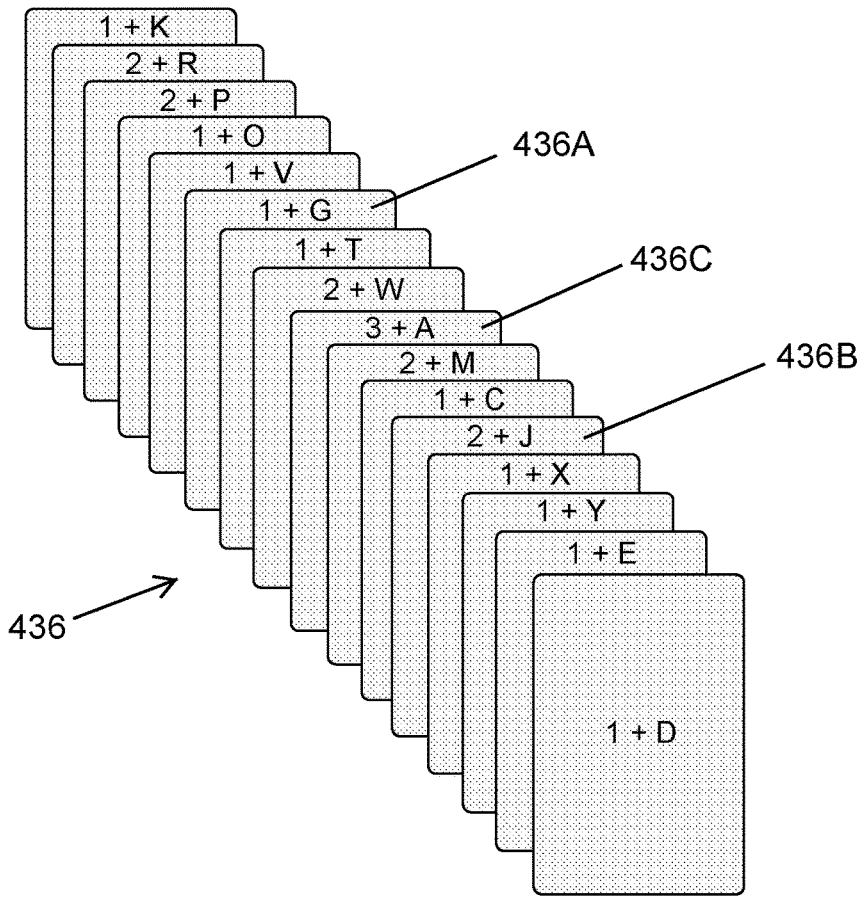
FIG. 4B is a simplified perspective view of an embodiment of a plurality of Dice+Letter Cards that can be utilized by a player within the board game illustrated in FIG. 1.
Figure 4C:
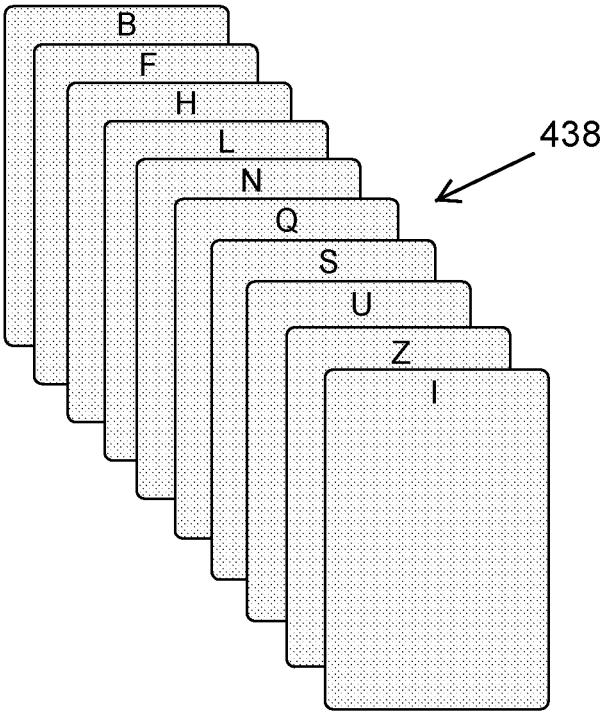
FIG. 4C is a simplified perspective view of an embodiment of a plurality of Letter Cards that can be utilized by a player within the board game illustrated in FIG. 1.
Figure 4D:
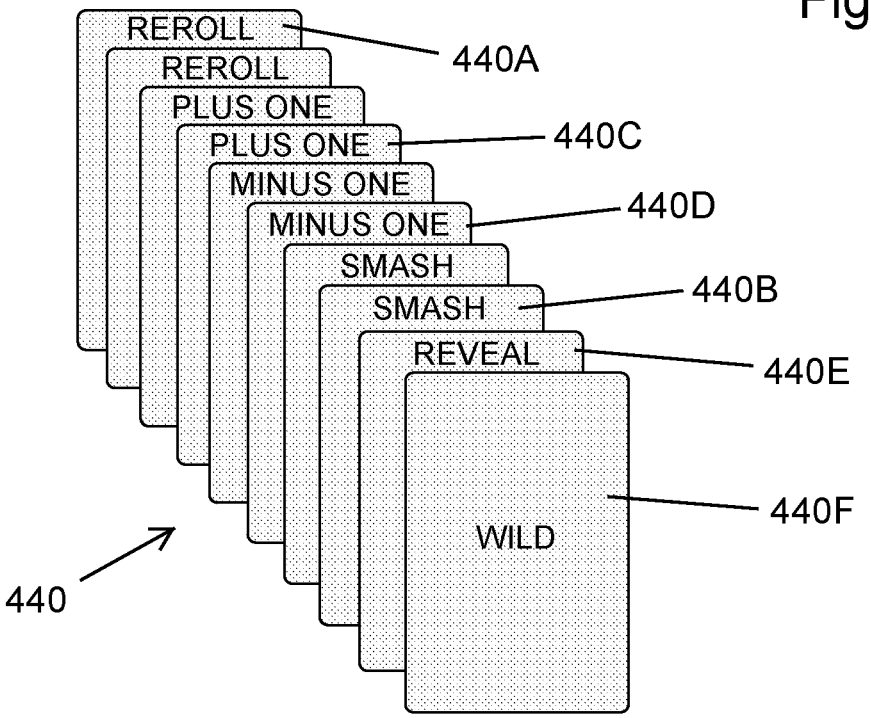
FIG. 4D is a simplified perspective view of an embodiment of a plurality of Power Cards that can be utilized by a player within the board game illustrated in FIG. 1.

In various embodiments, as illustrated herein, each card deck 22 comprises a combination of Dice Cards 434 (illustrated in FIG. 4A), Dice+Letter Cards 436 (illustrated in FIG. 4B), Letter Cards 438 (illustrated in FIG. 4C) and Power Cards 440 (illustrated in FIG. 4D).

Additionally, as noted above, each card deck 22 can have a unique card identifier or card ID that distinguishes each card deck 22 from each of the other card decks 22. More specifically, each card identifier can include a color, a symbol, a shape, a design, a logo, a branding, or some other suitable form of card identifier that serves to distinguish one player's card deck 22 from the card decks 22 of each of the other players.

Figure 5:
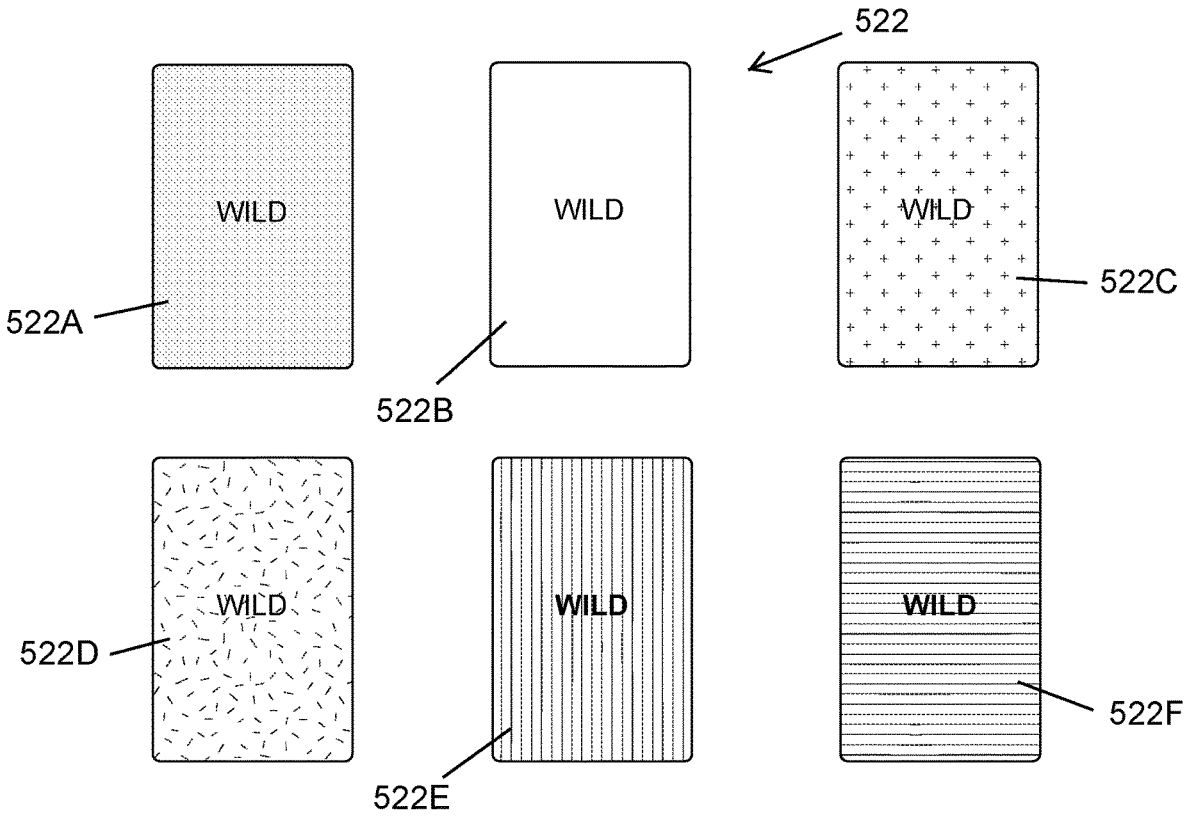
FIG. 5 is a simplified schematic illustration of alternative card decks that can each be utilized by a player within the board game illustrated in FIG. 1, each card set having a unique card identifier.

FIG. 5 is a simplified schematic illustration of alternative card decks 522 that can each be utilized by a player within the board game 10 illustrated in FIG. 1. As shown, each card deck 522 can have a unique card identifier. For example, as shown in FIG. 5, each card deck 522 can be identified with a color-based card identifier. For example, in one non-exclusive alternative embodiment, the game 10 can be designed with a gemstone theme, and the card identifiers for the card decks 522 can include six gemstone colors: gold 522A; sapphire 522B; emerald 522C; ruby 522D; copper 522E; and silver 522F. Alternatively, the card identifiers can take another suitable form.

Further, the number of cards that are included within each of the card decks 522 can also be varied. In one non-exclusive alternative embodiment, each card deck 522 includes sixty total cards. Still further, the types of each card with the card decks 522 can also be varied. For example, in one non-exclusive alternative embodiment, each card deck 522 can include twenty-four Dice Cards 434, sixteen Dice+Letter Cards 436, ten Letter Cards 438, and ten Power Cards 440. Alternatively, the total number of cards in each card deck 522 can be greater than or less than sixty, and/or the number of each type of card 434, 436, 438, 440 can be greater than or less than numbers specifically noted above.

Returning back to FIG. 4A, this Figure is a simplified top view illustration of an embodiment of a plurality of Dice Cards 434 that can be utilized by a player within the board game 10 illustrated in FIG. 1. Dice Cards 434 are designed to indicate, or provide a base number for, the number of dice 26 a player rolls against an opponent (or opponents), i.e. in the Dice Roll Round, and/or the number of spins of the letter wheel 28 against an opponent (or opponents), i.e. in the Letter Spin Round. In some embodiments, the number of dice 26 (or die) rolled by a player or the number of spins of the letter wheel 28 as indicated on the Dice Card 434 is 1, 2, or 3. More specifically, in one non-exclusive such embodiment, if the total number of Dice Cards 434 is twenty-four, each card deck 22 can include fifteen Dice Cards showing the number "1" 434A (hereinafter referred to as "1 Die Cards"); seven Dice Cards showing the number "2" 434B (hereinafter referred to as "2 Dice Cards"); and two Dice Cards showing the number "3" 434C (hereinafter referred to as "3 Dice Cards").

FIG. 4B is a simplified perspective view of an embodiment of a plurality of Dice+Letter Cards 436 that can be utilized by a player within the board game 10 illustrated in FIG. 1. Dice+Letter Cards 436 are also designed to indicate, or provide a base number for, the number of dice 26 a player rolls against an opponent (or opponents), i.e. in the Dice Roll Round, and/or the number of spins of the letter wheel 28 against an opponent (or opponents), i.e. in the Letter Spin Round. The letter on the Dice+Letter Cards 436 has no value or meaning during the Dice Roll Round, but comes into play during the Letter Spin Round where in addition to the number which indicates the spins of the letter wheel 28, the player immediately scores a guess of that particular letter denoted on the played Dice+Letter Card 436 as well. By way of example, if a player wins the Dice Roll Round with a "2+L Dice Card," then that player spins the letter wheel 28 two times and also scores an immediate letter "L" guess with regard to all opponents' hidden words.

As noted above, in some embodiments, each card deck 22 can include sixteen Dice+Letter Cards 436. For example, in one non-exclusive alternative embodiment, each card deck 22 can include ten Dice+Letter Cards showing the number "1" plus a letter 436A (hereinafter referred to as "1+Letter Die Cards"); five Dice+Letter Cards showing the number "2" plus a letter 436B (hereinafter referred to as "2+Letter Dice Cards"); and one Dice+Letter Card showing the number "3" plus a letter 436C (hereinafter referred to as "3+Letter Dice Cards").

FIG. 4C is a simplified perspective view of an embodiment of a plurality of Letter Cards 438 that can be utilized by a player within the board game 10 illustrated in FIG. 1. Similar to the Dice+Letter Cards 436, the letter on the Letter Cards 438 has no value or meaning during the Dice Roll Round, but comes into play during the Letter Spin Round where the player can utilize a Letter Card 438 that he or she has chosen to apply to immediately score a guess of that particular letter denoted on the played Letter Card 438. By way of example, if a player wins the Dice Roll Round, and has previously chosen to apply a Letter Card 438 with the letter "L", then that player also scores an immediate letter "L" guess with regard to all opponents' hidden words, in addition to what the player might spin on the letter wheel 28 during the Letter Spin Round.

FIG. 4D is a simplified perspective view of an embodiment of a plurality of Power Cards 440 that can be utilized by a player within the board game 10 illustrated in FIG. 1. At least some of the Power Cards 440 are designed to impact the base number on the Dice Cards 434 and/or Dice+Letter Cards 436. In certain embodiments, the Power Cards 440 can include Reroll Power Cards 440A; Smash Power Cards 440B; Plus One Power Cards 440C; Minus One Power Cards 440D; at least one Reveal Power Card 440E; and at least one Wild Power Card 440F.

The number of each type of Power Card 440A-440F in the card deck 22 can be varied. For example, in one non-exclusive alternative embodiment, each card deck 22 can include two Reroll Power Cards 440A, two Smash Power Cards 440B, two Plus One Power Cards 440C, two Minus One Power Cards 440D, at least one Reveal Power Card 440E, and at least one Wild Power Card 440F.

Figure 6:
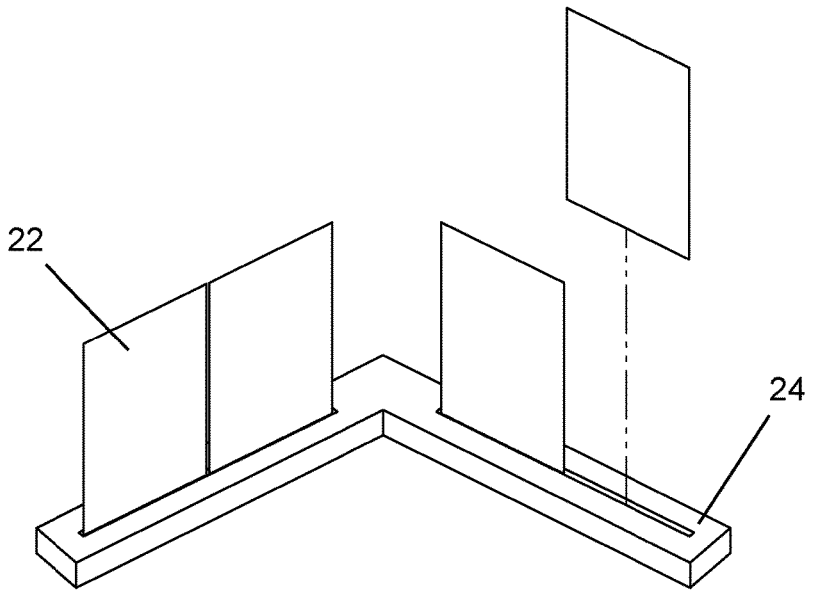
FIG. 6 is a simplified perspective view of an embodiment of a card rack that can be utilized by a player within the board game illustrated in FIG. 1.

During regular play in the Draw Round, the player with the game button 30 begins the Draw Round by drawing a card 22 from their card deck 22. If the card 22 is a Dice Card 434 or a Dice+Letter Card 436, then the player lays the card face up for all the players to see. If the drawn card 22 is a Letter Card 438 or a Power Card 440, then the player sets the card in their card rack 24 for future use and repeats the draw process until a Dice Card 434 or a Dice+Letter Card 436 is drawn. FIG. 6 is a simplified perspective view of an embodiment of the card rack 24 that can be utilized by a player within the board game 10 illustrated in FIG. 1.

In certain embodiments, a player can only have a predetermined number of Letter Cards 438 and/or Power Cards 440 in their card rack 24 at any given time. In one such embodiment, the predetermined number of Letter Cards 438 and/or Power Cards 440 is four per player. Any additional Letter Cards 438 and/or Power Cards 440 can be exchanged with other drawn Letter Cards 438 and/or Power Cards 440 within that player's card rack 24 if the player so desires, but a discard must be made so as not to exceed the predetermined number of Letter Cards 438 and/or Power Cards 440 per player.

Additionally, in some embodiments, all Letter Cards 438 and all Power Cards 440, except the Reroll Power Cards 440A and the Smash Power Cards 440B, in a player's card rack 24 can be played only during a player's turn during the Draw Round. Stated in another manner, in such embodiment, a player must determine if they wish to apply each of the Letter Cards 438, each of the Plus One Power Cards 440C, each of the Minus One Power Cards 440D, each of the Reveal Power Cards 440E, and each of the Wild Power Cards 440F that such player may have on their card rack 24 during the Draw Round. The application of such cards will now be described before moving on to the description of the ensuing rounds.

The Letter Card 438 is a single letter card that can be added to a player's Dice Card 434 or Dice+Letter Card 436 to score a letter guess of the designated letter against all opponents in the event such player wins the Dice Roll Round, as described below. In particular, in one embodiment, the Letter Card 438 is activated with a winning roll during the Dice Roll Round. Additionally, in certain embodiments, multiple Letter Cards 438 can be played at one time, i.e. in any given Set of Rounds.

The Plus One Power Card 440C is a Power Card 440 that adds an additional die 26 to the number of dice 26 that player rolls during the Dice Roll Round, and an additional spin of the letter wheel 28 in the Letter Spin Round if such player wins the Dice Roll Round. By way of example, Player A can elect to play a Plus One Power Card 440C on his drawn "2 Dice Card" 434B. Player A now has the equivalent of a "3 Dice Card" 434C for the Dice Roll Round. If Player A wins the Dice Roll Round, then Player A also spins the letter wheel 28 three times during the Letter Spin Round.

The Minus One Power Card 440D is a Power Card 440 that subtracts a die 26 from the number of dice 26 that a targeted player rolls during the Dice Roll Round, and would also result in one less spin of the letter wheel 28 in the Letter Spin Round if the targeted player wins the Dice Roll Round. Players can play Minus One Power Cards 440D on players who have not had their turn yet. By way of example, if Player A plays a Minus One Power Card 440D on Player B's "2 Dice Card" 434B, then Player B now has the equivalent of a "1 Die Card" 434A for that Dice Roll Round and would spin the letter wheel 28 in the Letter Spin Round one less times if Player B wins the Dice Roll Round. By way of another example, if a Minus One Power Card 440D is played on a targeted Player B's "1 Die Card" 434A and no Power Cards are used to positively impact Player B's Dice Card, then Player B has the equivalent of a "0 Dice Card" and will not roll during the Dice Roll Round.

A Reveal Power Card 440E is a Power Card 440 that forces a targeted opponent to reveal any single chosen letter tile 20 from their hidden word. The Reveal Power Card 440E is activated after a successful Dice Roll Round and must be used during the ensuing Letter Spin Round. By way of example, if Player A plays a Reveal Power Card 440E on his Dice Card and is the winner of the Dice Roll Round, then Player A can ask Player B to reveal a letter of their hidden word. Player A then asks Player B to reveal a particular letter, e.g., the last letter, of their word and Player B turns around or reveals the requested letter of the letter tile 20.

A Wild Power Card 440F is a Power Card 440 that can be added to a player's Dice Card to score an additional letter guess and can be activated with the winning of the Dice Roll Round and used during the ensuing Letter Spin Round.

Further, a Smash Power Card 440B, although it need not be played during the Draw Round, can also be played during the Draw Round. A Smash Power Card 440B is a Power Card 440 that destroys, negates, nullifies, or cancels any Letter Card 438 or Power Card 440 played during that round. In certain embodiments, Smash Power Cards 440B cannot target Dice Cards 434 or Dice+Letter Cards 436 or the spins of the letter wheel 28 during the Letter Spin Round. In some embodiments, even if a player's turn is completed, Smash Power Cards 440B can still be played to destroy other Power Cards 440 during the Draw Round. Players can work backwards, with the last played Smash Power Card 440B taking effect first, to resolve multiple played Smash Power Cards 440B.

By way of example, if Player A plays a Letter Card 438 during the Draw Round, then Player B can play a Smash Power Card 440B to cancel the Letter Card 438. In one embodiment, a player can play a Smash Power Card 440B on an opponent's played Smash Power Card 440B, thereby negating the effect of the original played Smash Power Card 440B.

By way of another example, if Player A plays a Plus One Power Card 440C during the Draw Round, then Player B can play a Smash Power Card 440B to nullify the played Plus One Power Card 440C. If Player A plays a Smash Power Card 440B on Player B's Smash Power Card 440B, this action thereby destroys the original played Smash Power Card's 440B effect on Player A's Plus One Power Card 440C.

In certain embodiments, Letter Cards 438 and Power Cards 440 can only be played once and then must be discarded after the Guess Round. In other embodiments, a player may play all available Letter Cards 438 and Power Cards 440 in one turn. In yet another embodiment, players may keep up to four Letter Cards 438 and/or Power Cards 440 in their card rack 24.

In some embodiments, once a player selects a Dice Card 434 or a Dice+Letter Card 436 and uses all desired Letter Cards 438 and Power Cards 440, the player picks up his dice 26 to indicate that his Draw Round turn is over.

In step 211, the Dice Roll Round begins when all players each have picked up their dice 26 to roll showing the end of the Draw Round.

During the Dice Roll Round, each player rolls the proper number of dice 26 from their dice set 26 as determined during the Draw Round, i.e. from the Dice Cards 434 or the Dice+Letter Cards 436 and any played Power Cards 440. Each die 26 in the dice set 26 can be a standard six-sided die.

As noted above, each player has their own dice set 26, which can include a unique dice identifier or dice ID that distinguishes each dice set 26 from each of the other dice sets 26. More specifically, each dice identifier can include a color, a symbol, a shape, a design, a logo, a branding, or some other suitable form of dice identifier that serves to distinguish one player's dice set 26 from the dice sets 26 of each of the other players.

Figure 7:
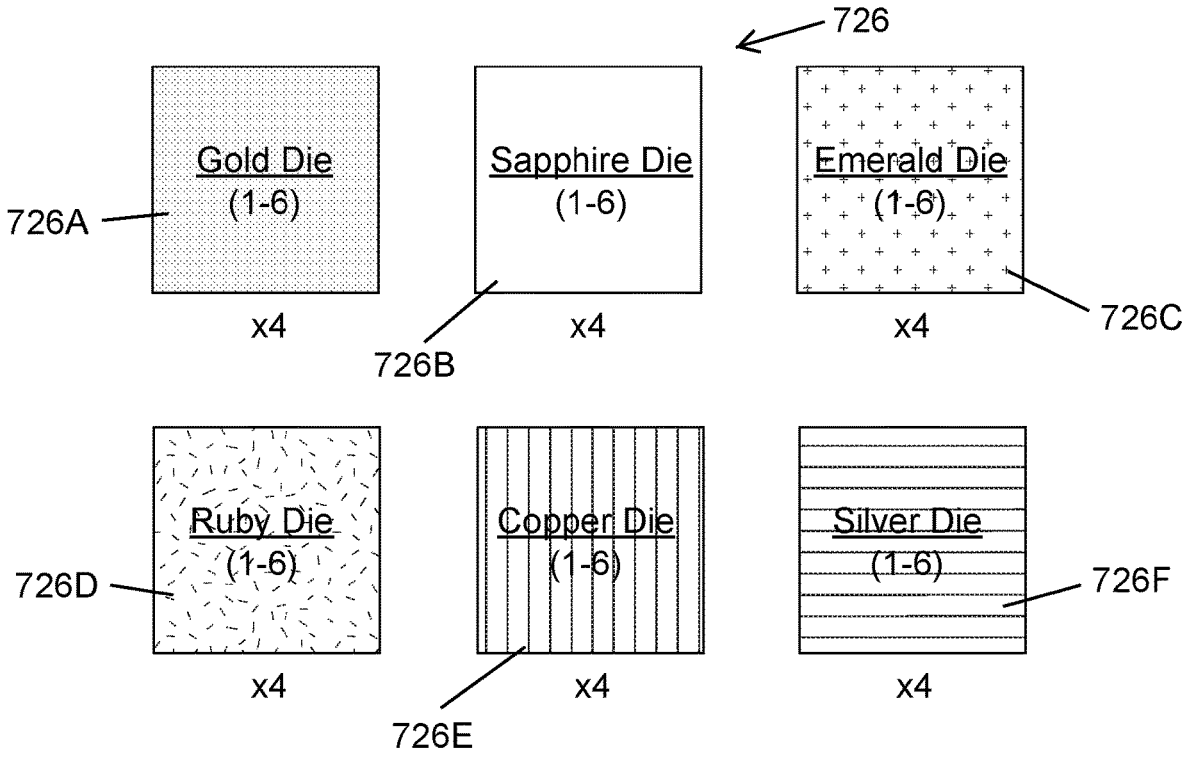
FIG. 7 is a simplified schematic illustration of alternative dice sets that can each be utilized by a player within the board game illustrated in FIG. 1, each dice set having a unique dice identifier.

FIG. 7 is a simplified schematic illustration of alternative dice sets 726 that can each be utilized by a player within the board game 10 illustrated in FIG. 1. As shown, each dice set 726 can have a unique dice identifier. For example, as shown in FIG. 7, each dice set 726 can be identified with a color-based dice identifier. For example, in one non-exclusive alternative embodiment, the game 10 can be designed with a gemstone theme, and the dice identifiers for the dice sets 726 can include six gemstone colors: gold 726A; sapphire 726B; emerald 726C; ruby 726D; copper 726E; and silver 726F. Alternatively, the dice identifiers can take another suitable form.

It should be appreciated that in certain embodiments, the unique dice identifier can correspond with the unique card identifier. Stated in another manner, in such embodiments, the unique dice identifier can utilize the same color, symbol, shape, design, logo, branding, etc. as the unique card identifier for any give player.

Further, the number of dice that are included within each of the dice sets 726 can also be varied. In one non-exclusive alternative embodiment, each dice set 726 includes four total dice.

As noted above, the number of dice 726 each player gets to roll from their dice set 726 during the Dice Roll Round is determined by the base number shown on their drawn Dice Card 423 or Dice+Letter Card 436, as well as any Power Cards 440 that have been played. By way of example, if a player turns over a "2 Dice Card" 434B, and no Power Cards 440 have been played on or against that "2 Dice Card" during the Draw Round, then that player rolls two dice 726 against his opponents during the Dice Roll Round. If victorious, then that player spins the letter wheel 28 two times during the Letter Spin Round.

Figure 8:
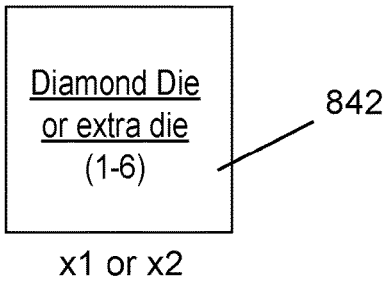
FIG. 8 is a simplified top view illustration of an embodiment of an additional die that can be utilized within the board game illustrated in FIG. 1.

It should be understood that in certain limited circumstances, a player may get to roll more than four dice 726 during the Dice Roll Round. Thus, in some embodiments, an additional die or dice can be included within the general, game components 16 (illustrated in FIG. 1). FIG. 8 is a simplified top view illustration of an embodiment of an additional die 842 that can be utilized within the board game 10 illustrated in FIG. 1. The additional die 842 (or pair of dice), is preferably distinct in some manner from each player's dice set 726 such as in color or shape (e.g., diamond in shape), in the instance (long shot) a player scores an additional roll or two rolls in the Dice Roll Round. An alternative to having such an additional die 842 or dice (distinct from a player's own dice set 726) is to perform extra rolls earned through the Dice Roll Round by re-rolling a die or dice from a player's set of four dice 726.

Players roll their specified number of dice 726 (or die if the base number is 1) from their dice set 726 at the same time. Each player adds up the total value of their roll and then the player with the highest rolled value wins the Dice Roll Round.

In certain embodiments, the winner of the Dice Roll Round is the controlling player and is therefore the only player who proceeds to the Letter Spin Round. As noted above, in certain embodiments, the Reroll Power Cards 440A and the Smash Power Cards 440B are the only Power Cards 440 that can be chosen to be played outside of the Draw Round, e.g., during the Dice Roll Round. Thus, in some embodiments, opposing players have the option to use a Reroll Power Card 440A during this Dice Roll Round. Targeted players must reroll their dice 726 unless a Smash Power Card 440B is used to destroy the Reroll Power Card 440A.

The Reroll Power Card 440A is a Power Card 440 that can make a targeted player reroll in the Dice Roll Round. By way of example, Player A rolls a combined score of eight with his two rolled dice 726. Player B rolls a 6 (six) with his 1 (one) rolled die 726. Player B plays a Reroll Power Card 440A to make Player A roll again. Player A rolls a five and Player B wins the Dice Roll Round. By way of another example, Player A plays a Smash Power Card 440B in response to Player B's Reroll Power Card 440A and the Smash Power Card 440B trumps the Reroll Power Card 440A. Player A does not have to roll again because the original roll stands and Player A wins the Dice Roll Round.

Additionally, in some embodiments, in the event of multiple players rolling the same high score, those players proceed to an extended Dice Roll Round called a Duel to determine who wins control of the Dice Roll Round. In such a Duel, all tied high score players roll their determined number of dice 726 (per the base number shown on their Dice Card 434 or Dice+Letter Card 436, as modified by any played Power Cards 440). All Power Cards remain in effect and players can use Reroll Power Cards 440A during the Duel. Players roll until one player rolls a higher total value than the other players. That player is the winner of the Dice Roll Round and now is the controlling player.

In one embodiment of a Duel, the losing players of a Duel must turn face up all of their remaining Letter Cards 438 or Power Cards 440. These Letter Cards 438 or Power Cards 440 negatively impact each losing player or players solely and immediately as if they were scored during the regular game. In such embodiment, all Plus One Power Cards 440C or Minus One Power Cards 440D that are turned over are treated as Plus One Power Cards 440C resulting in that number of additional letter wheel 28 spins directed against the losing player of the Duel by the winner of the Dice Roll Round. In another embodiment of a Duel, any Dice+Letter Cards 436 played by losing players would now have those letters played against themselves directly. The Duel results take place before the Letter Spin Round. In certain embodiments, players not involved in a Duel are not impacted by the Duel results.

As noted, the winning player of the Dice Roll Round is the controlling player, and may be the only player entitled to participate in the Letter Spin Round and the Guess Round. In step 213, the play-of-game now proceeds to the Letter Spin Round (or Letter Die Roll Round if the game 10 includes a letter die 1032 (illustrated in FIG. 10) rather than a letter wheel 28 (illustrated in FIG. 1)). For simplicity purposes, this round can be referred to as the Letter Spin Round regardless of whether the letter wheel 28 or the letter die 1032 is being used.

Figure 9:
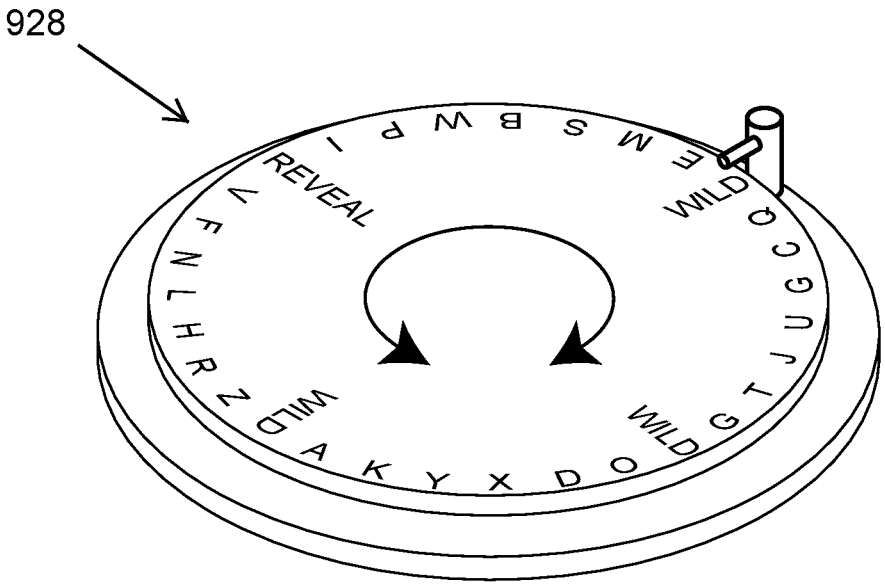
FIG. 9 is a simplified perspective view of an embodiment of a Letter Wheel that can be utilized within the board game illustrated in FIG. 1.
Figure 10:
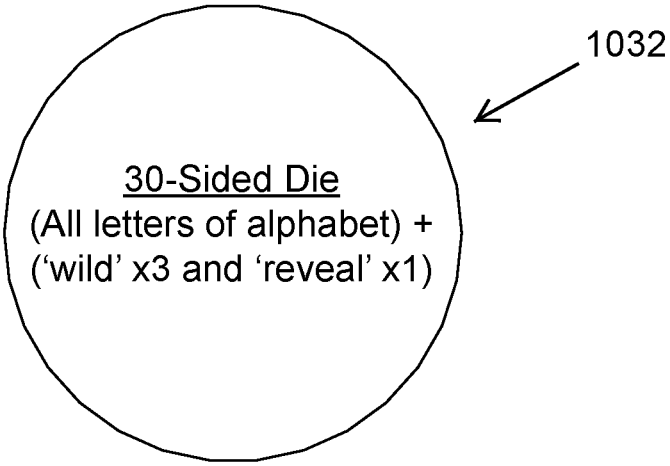
FIG. 10 is a simplified schematic illustration of an embodiment of a Letter Die that can be utilized within the board game illustrated in FIG. 1.

FIG. 9 is a simplified perspective view of an embodiment of a letter wheel 928 that can be utilized within the board game 10 illustrated in FIG. 1. In such embodiment, the letter wheel 928 includes thirty individual spaces, with each of the letters of the alphabet appearing once, a Wild denoted in three spaces, and a Reveal denoted in one space Alternatively, FIG. 10 is a simplified schematic illustration of an embodiment of a letter die 1032 that can be utilized within the board game 10 illustrated in FIG. 1. The letter die 1032 can be utilized as an alternative to the letter wheel 928. FIG. 10 illustrates that the letter die 1032 can be a thirty-sided die having each letter of the alphabet denoted on one of twenty-six sides, a Wild denoted on three sides, and Reveal denoted on one side.

As noted, in certain embodiments, the controlling player is the only player who spins in the Letter Spin Round. In another embodiment, the controlling player does not reveal any letters of his own formed word during this Letter Spin Round.

Before the controlling player spins the letter wheel 928, the player announces any letters found on his or her Dice+Letter Card 436 (if such a Dice+Letter Card 436 had been turned over during the Draw Round) and on any additional Letter Cards 438 that such player had previously indicated that he or she wanted to apply during this set of rounds. All opponents reveal any of these letters if they can be found in their (hidden) formed word. For example, if the controlling player has a Dice+Letter Card 436 of "2+J", then all opponents must turn around (or reveal) any letter tile 20 "J" in their hidden formed word.

The controlling player then spins the letter wheel 928 equal to the number on their Dice Card 434 or Dice+Letter Card 436, as modified by any played Power Cards (which is the same number of dice 726 the controlling player rolled during the Dice Roll Round). For example, if the controlling player rolled two dice 726 in the Dice Roll Round, then the controlling player spins the letter wheel 928 two times. After each spin, all players (except the controlling player) reveal the spun letter if that letter tile 20 letter is found in their hidden word. For example, the controlling player spins a "W" on the letter wheel 928 and an opponent's word is "WOW," then the opponent turns around (or reveals) both "W" letter tiles 20.

In one embodiment, any Wild Power Card 440F or Reveal Power Card 440E can be played in this Letter Spin Round. The controlling player guesses any letter desired and all players (except for the controlling player) reveals this letter tile 20 if found in their hidden word. Additionally, if the controlling player spins and the letter wheel 928 (or letter die 1032) lands on a "Wild" or "Reveal" space, then the controlling player treats these just as Power Cards 440, except Smash Power Cards 440B cannot be played against them. If a letter on the letter wheel 28 is spun repeatedly, there are no re-spins of the letter wheel 928. After all spins are taken by the controlling player and all letters are revealed by all opponents, the Letter Spin Round is completed and play-of-game proceeds to the Guess Round.

In step 215, i.e. the Guess Round, only the controlling player has the option to guess any opponent's word. A correct guess of an opponent's word eliminates that player from the game. In one embodiment, an incorrect guess eliminates the controlling player from the game. In another embodiment, the controlling player can take a guess at any number of opponents' words at his own risk. In another embodiment, table talk is not permitted during the Guess Round. The Guess Round is over when the controlling player no longer wishes to guess any opponents' words or if there is only one player remaining who has not had their word revealed/guessed properly.

In some embodiments, if the controlling player chooses not to guess an opponent's word, the played cards 22 of each player are put in the discard pile. Then, in step 217, the play-of-game proceeds again to the Draw Round, and a new Set of Rounds, where the game button 30 is passed in a clockwise fashion to the player who will go first in the next Draw Round. Play-of-game then proceeds through the various rounds as described above until one player remains with an unguessed word.

In the event that there is only one player remaining who has not had their word revealed/guessed properly, that remaining player is declared to be the winner of the game. In some embodiments, in the event it is discovered that a winning player had failed to reveal a letter, whether by accident or intention, then that player forfeits the game.

Figure 11:
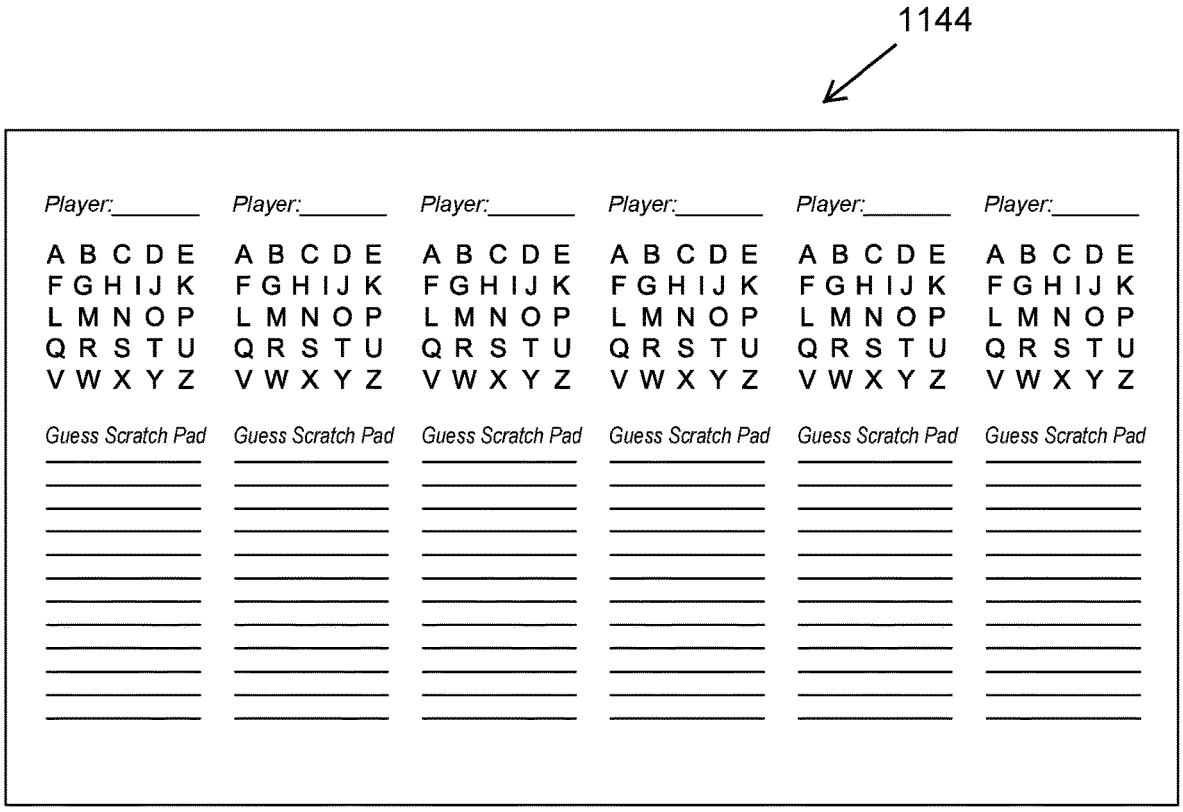
FIG. 11 is a simplified top view illustration of an embodiment of a scratch pad that can be utilized within the board game illustrated in FIG. 1 for tracking each player's letters and guesses.

FIG. 11 is a simplified top view illustration of an embodiment of a scratch pad 1144 that can be utilized within the board game 10 illustrated in FIG. 1. In particular, as illustrated, each player can utilize their own scratch pad 1144 for purposes of tracking each player's letters and guesses.

As provided herein, the word-forming and word-guessing game 10, game board 12, and/or game components 14, 16 may be color-coded per player and/or may comprise graphics, designs, and/or accompanying character figures. Such character figures may correspond to the provided graphics and/or designs. Graphics, designs and/or characters may include any desired graphic, design, or character whether already known or newly created. Many graphics, designs, and/or characters are well known and may include and/or be inspired from, without limitation, branding graphics and/or names, anime, animations such as Disney or Pixar animations, sports teams, and/or combinations thereof.

Figure 12:
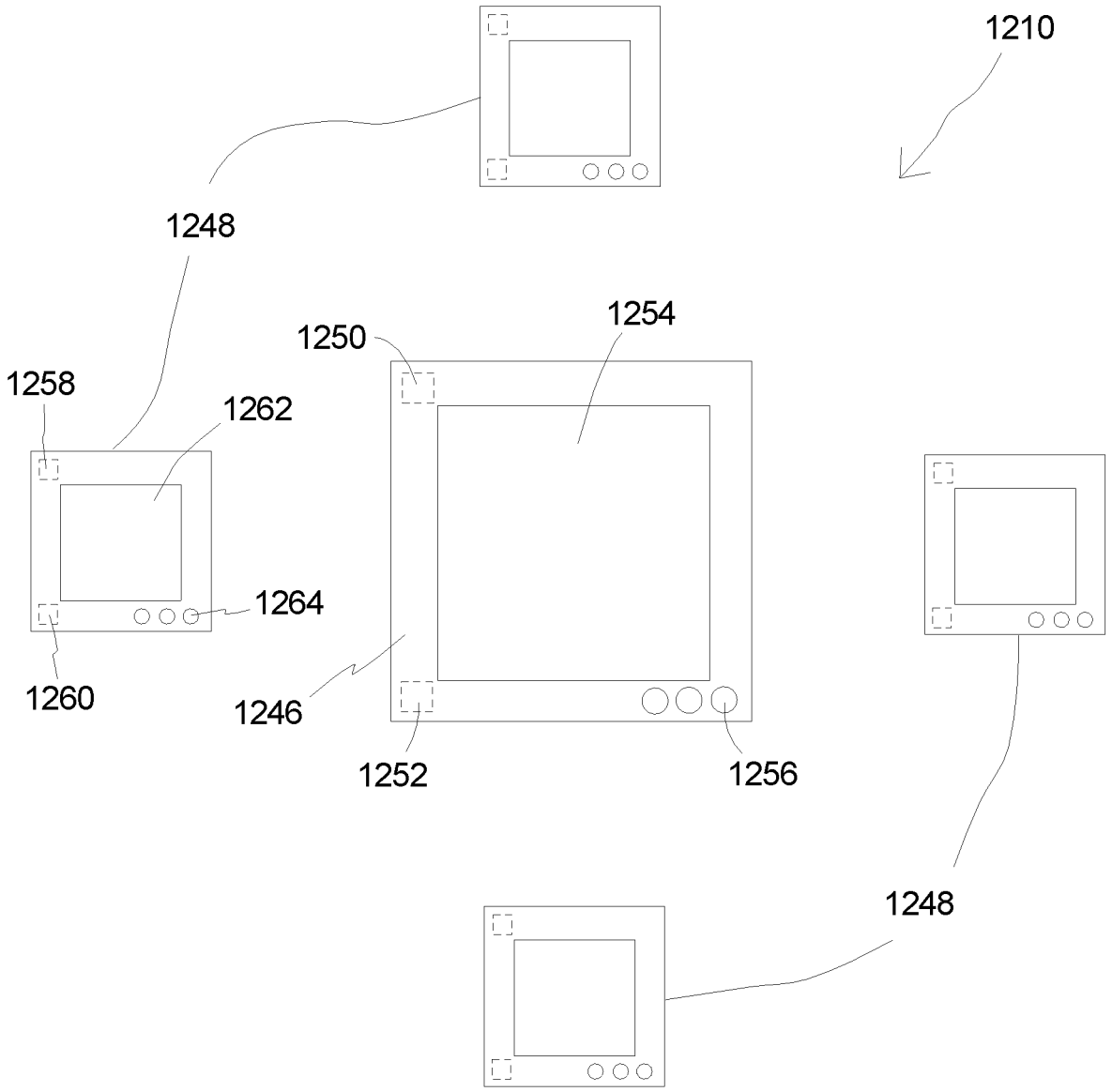
FIG. 12 is a simplified schematic illustration of another embodiment of the word-forming and word-guessing game having features of the present invention.

FIG. 12 is a simplified schematic illustration of another embodiment of the word-forming and word-guessing game 1210 having features of the present invention. In particular, FIG. 12 illustrates an electronic version of the word-forming and word-guessing (board) game 1210 in which various game components, e.g., card decks, dice sets, sets of letter tiles, game board, and letter wheels, are provided to the players in an electronic format.

As shown in this embodiment, the word-forming and word-guessing game 1210 includes a game controller 1246 and a plurality of player controllers 1248 (e.g., hand-held player controllers) that are electronically coupled to the game controller 1246. It should be appreciated that, in alternative embodiments, the plurality of player controllers 1248 can be electronically coupled to the game controller 1246 via a wired connection or via a wireless connection.

Additionally, the word-forming and word-guessing game 1210 can include more components that may correspond with the various components illustrated and described herein above. Alternatively, the word-forming and word-guessing game 1210 can be designed without the plurality of player controllers 1248. In such alternative embodiment, each of the players in the game 1210 can access and play the game 1210 via the game controller 1246.

The design of the game controller 1246 can be varied. For example, in certain embodiments, the game controller 1246 can include one or more processors and circuits 1250 (illustrated in phantom), and a storage or memory device 1252 (illustrated in phantom) to enable proper operation of the game controller 1246 during play of the game 1210. Additionally, as shown, the game controller 1246 can include a video display 1254 that is configured to coordinate and display to each of the players the various components, features and aspects of the word-forming and word-guessing game 1210 that were noted as being displayed on the game board in the embodiments illustrated and described above. The game controller 1246 can also be configured to provide an accurate update on the full and complete status of the game for each of the players at all times. Further, as illustrated in this embodiment, the game controller 1246 can include one or more control buttons 1256 (three are shown in FIG. 12) that can be utilized to facilitate and control play of the game 1210. Additionally and/or alternatively, the game controller 1246 can include touchscreen capabilities to facilitate and control play of the game 1210. Still alternatively, the game controller 1246 can employ the use of a mouse and/or keyboard (not shown) to facilitate play of the game 1210.

Somewhat similarly, the design of each of the plurality of player controllers 1248 can also be varied. For example, in some embodiments, each of the player controllers 1248 can include one or more processors and circuits 1258 (illustrated in phantom), and a storage or memory device 1260 (illustrated in phantom) to enable proper operation of the player controllers 1248 during play of the game 1210. Additionally, as shown, each of the player controllers 1248 can include a video display 1262 that is configured to coordinate and display to each of the players the various components, features and aspects of the word-forming and word-guessing game 1210 that were noted as being displayed on the game board in the embodiments illustrated and described above. The player controllers 1248 can also be configured to provide an accurate update on the full and complete status of the game for each of the players at all times. Further, as illustrated in this embodiment, each of the game controllers 1248 can include one or more control buttons 1264 (three are shown in FIG. 12) that can be utilized to facilitate and control play of the game 1210. Additionally and/or alternatively, the player controllers 1248 can include touchscreen capabilities and/or can employ the use of a mouse and/or keyboard (not shown) to facilitate and control play of the game 1210.

As provided herein, the player controllers 1248 can be configured to enable each of the players to perform the various steps and actions required during play of the game 1210, as were described in detail above. For example, the player controllers 1248 can be configured to enable the players to perform the necessary actions, i.e. electronically, to form hidden words with the sets of tiles, to draw cards during the Draw Round, to roll dice during the Dice Roll Round, to play and/or hold the cards that have been drawn during the Draw Round, and to spin the letter wheel during the Letter Spin Round (and/or roll the letter die during the Letter Die Roll Round). As the players perform the necessary actions on or with the player controllers 1248, the appropriate actions are then displayed on the game controller 1246 due to the electronic coupling between the game controller 1246 and the player controllers 1248, such that each of the players can appropriately interact and compete with all of the other players.

It should be appreciated that in certain alternative embodiments, all of the features and actions of the game can be fully and completely controlled through the use of just an appropriately designed game controller without the need for any individual player controllers.

In summary, as provided herein, the word-forming and word-guessing game 10 of the present invention comprises a set of letter tiles 20, a card deck 22, and a dice set 26 per player designed in such a manner so as to carry out the play-of-game with one or more opponents. The word-forming and word-guessing game components are utilized by each player to execute word formation of letter tiles 20 and ultimately word-guessing of an opponent's formed (hidden) words through strategic execution of the play-of-the-game.

The game and game components disclosed herein, in both physical and electronic versions, may incorporate reasonable design parameters, features, modifications, advantages, and variations that are readily apparent to those skilled in the art in the field of the game design and/or board game industry.

Without departing from the scope and spirit of the present invention, reasonable features, modifications, advantages, and design variations of the claimed invention will become readily apparent to those skilled in the art by following the guidelines set forth in the preceding detailed description and embodiments.

It is understood that although a number of different embodiments of a word-forming and word-guessing game and corresponding method of play of game have been illustrated and described herein, one or more features of any one embodiment can be combined with one or more features of one or more of the other embodiments, provided that such combination satisfies the intent of the present invention.

While a number of exemplary aspects and embodiments of a word-forming and word-guessing game and corresponding method of play of game have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for playing a multi-player board game between at least a first player and a second player, the method comprising:

the first player selecting a first letter tile set including a plurality of first letter tiles, a first card deck including a plurality of first cards, and a first dice set including a plurality of first dice;

the first player utilizing at least a portion of the first letter tiles from the first letter tile set to form a first word;

the first player vertically aligning the at least a portion of the first letter tiles from the first letter tile set that form the first word relative to one another such that the first word is spelled out vertically from top to bottom;

the second player selecting a second letter tile set including a plurality of second letter tiles, a second card deck including a plurality of second cards, and a second dice set including a plurality of second dice;

the second player utilizing at least a portion of the second letter tiles from the second letter tile set to form a second word;

the second player vertically aligning the at least a portion of the second letter tiles from the second letter tile set that form the second word relative to one another such that the second word is spelled out vertically from top to bottom;

the first player utilizing one or more cards from their card deck and one or more dice from their dice set to win an opportunity to have the second player selectively reveal at least one of the letter tiles that form the word of the second player; and the first player further utilizing the one or more cards from their card deck and the one or more dice from their dice set to win an opportunity to guess the word of the second player.

2. The method of claim 1 further comprising each of the players drawing one or more cards from their card deck during a Draw Round; and each of the players rolling one or more dice from their dice set during a Dice Roll Round, the number of dice being rolled by each of the players during the Dice Roll Round being based at least in part on the one or more cards that each of the players drew from their card deck during the Draw Round.

3. The method of claim 2 wherein the first player, based on the outcome of each of the players rolling the one or more dice from their dice set during the Dice Roll Round, wins the opportunity to have the second player selectively reveal the at least one of the letter tiles that form the word of the second player during a Letter Spin Round.

4. The method of claim 3 wherein the first player, based on the outcome of each of the players rolling the one or more dice from their dice set during the Dice Roll Round, wins the opportunity to guess the word of the second player during a Guess Round.

5. The method of claim 1 wherein the first player selecting includes the first card deck including a first card identifier that distinguishes the first card deck from the second card deck and the first dice set including a first dice identifier that distinguishes the first dice set from the second dice set, the first dice identifier corresponding with the first card identifier; and wherein the second player selecting includes the second card deck including a second card identifier that distinguishes the second card deck from the first card deck and the second dice set including a second dice identifier that distinguishes the second dice set from the first dice set, the second dice identifier corresponding with the second card identifier.

* * * * *